US006099973A

United States Patent [19]

Miyai et al.

[11] Patent Number: 6,099,973

[45] Date of Patent: Aug. 8, 2000

[54] PRESSURE-SENSITIVE MAGNETIC TRANSFER RECORDING MEDIUM

[75] Inventors: Kazuo Miyai; Yasuhiro Tanikawa; Kyoichi Suzuki, all of Osaka, Japan

[73] Assignee: Fujicopian Co., Ltd., Osaka, Japan

[21] Appl. No.: 09/078,411

[22] Filed: May 13, 1998

[30] Foreign Application Priority Data

May 13, 1997 [JP] Japan ..... 9-122370

[51] Int. Cl.[7] ..... B41M 5/26

[52] U.S. Cl. ..... 428/532; 428/195; 428/206; 428/329; 428/694 B

[58] Field of Search ..... 428/195, 206, 428/532, 329, 694 B

[56] References Cited

U.S. PATENT DOCUMENTS

| | | | |
|---|---|---|---|
| 3,515,590 | 6/1970 | Lazzarini | 117/235 |
| 4,211,826 | 7/1980 | Du | 428/497 |
| 4,260,664 | 4/1981 | Dapp | 428/476.9 |
| 5,523,167 | 6/1996 | Hunt | 428/484 |
| 5,712,045 | 1/1998 | Miyai | 428/522 |

FOREIGN PATENT DOCUMENTS

| | | | |
|---|---|---|---|
| 09226235 | 9/1997 | Japan | B41M 5/10 |

OTHER PUBLICATIONS

WPI Database, Section Ch, Week 9722, Derwent Publications Ltd., London, GB; Class A89, AN 97–238959, XP002076728 and JP 09 052438 A (Fujicopian Co. Ltd.); Feb. 25, 1997.

*Primary Examiner*—Pamela R. Schwartz
*Attorney, Agent, or Firm*—Fish & Neave

[57] ABSTRACT

A pressure-sensitive magnetic transfer recording medium comprising a support and a pressure-sensitive transferable magnetic ink layer provided on the support, the pressure-sensitive transferable magnetic ink layer comprising a particulate magnetic substance, a resin and an oily substance, the resin comprising a cellulose acetate butyrate resin having a number average molecular weight of $2.0\times10^4$ to $5.0\times10^4$ and a glass transition point of 100° to 140° C., the oily substance being compatible with the cellulose acetate butyrate resin, and the mixing ratio of the cellulose acetate butyrate to the oily substance being from 3:10 to 7:5 by weight, wherein the oily substance is at least one member selected from the group consisting of an adipic acid ester, a sebacic acid ester, an azelaic acid ester and a trimethylolpropane fatty acid triester.

1 Claim, No Drawings

PRESSURE-SENSITIVE MAGNETIC TRANSFER RECORDING MEDIUM

BACKGROUND OF THE INVENTION

The present invention relates to a pressure-sensitive magnetic transfer recording medium. More particularly, it relates to a pressure-sensitive magnetic transfer recording medium which allows an impact printer to easily produce printed images having high magnetic characteristics capable of being read by means of a magnetic ink character reader (hereinafter referred to as "MICR").

MICR is designed to read printed magnetic images, such as characters or marks, printed with an ink containing a magnetic substance powder on a bill, check, credit card, pass, traffic census card or the like, by means of a magnetic head. The magnetic head in the MICR converts magnetic variations in magnetic images comprising various characters or marks into predetermined signals, the voltages of which are detected to recognize the characters or marks.

Characters or marks to be read by means of the magnetic head are required to have predetermined shape, dimensions and allowable ranges of dimensions as well as a predetermined magnetic signal level. In Japan, the allowable ranges with respect to E13B type face adopted in American Bank Association are prescribed in JIS X 9002.

E13B type face prescribed in JIS X 9002 consists of 14 characters in all, including 10 numerals (0 to 9) and 4 special marks. With respect to each character for E13B type face, JIS X 9002 prescribes nominal height, width and corner radius, and allowable ranges of these nominal dimensions as well as the allowable range of void.

In addition to E13B type face, there is CMC-7 type face as type face for MICR. CMC-7 type face is designed to form a character by arranging 7 longitudinal bars with 2 kinds of intervals and any character of CMC-7 type face can be magnetically recognized by combinations of 2 kinds of intervals. CMC-7 type face consists of 41 characters in all, including 10 numerals, 26 large alphabets and 5 special marks. A standard with respect to dimensions and magnetic characteristics of CMC-7 type face characters is prescribed by ECMA (European Computer Manufacturers Association).

Printed images of the above-mentioned type faces for MICR are formed by using a pressure-sensitive magnetic transfer recording medium which is produced by applying a magnetic ink composition usually composed of a magnetic substance powder and a vehicle comprising a resin and an oil on a support such as plastic film and drying the resultant coating to form a pressure-sensitive transferable magnetic ink layer. Using an impact printer such as a typewriter and a wire dot printer, the pressure-sensitive transferable magnetic ink layer of the recording medium is selectively transferred onto a receiving paper by action of pressure to form a magnetic image.

With respect to impact printers for MICR, there is a trend wherein the striking pressure in printing is lowered from the viewpoints of low noises and low costs and, hence, there is an increasing demand for high transfer sensitivity in pressure-sensitive magnetic transfer recording media used in such impact printers.

It is possible to cope with the high transfer sensitivity by means such as use of a resin having a low glass transition point, an increase of the amount of the plasticizer component contained, or the like. However, these means cause drawbacks such as blocking of an ink ribbon and production of printed images with poor scratch resistance. Herein, the term "blocking" refers to the phenomenon wherein when an ink ribbon having an ink layer on a support wound in the form of a roll is exposed to a high temperature enviroment, the ink of the ink layer is migrated to the rear side of the support contacting the front side of the ink layer, and the ink layer and the support adhere to each other, resulting in hindrance in unwinding the ink ribbon.

In view of the above-mentioned problems of the prior art, it is an object of the present invention to provide a pressure-sensitive magnetic transfer recording medium which is capable of preventing blocking of the pressure-sensitive transferable magnetic ink layer during storage at high temperatures as well as the lowering of the scratch resistance of printed images which are caused by increasing the transfer sensitivity of the conventional magnetic ink layer.

This and other objects of the present invention will become apparent from the description hereinafter.

SUMMARY OF THE INVENTION

The present invention provides a pressure-sensitive magnetic transfer recording medium comprising a support and a pressure-sensitive transferable magnetic ink layer provided on the support, the pressure-sensitive transferable magnetic ink layer comprising a particulate magnetic substance, a resin and an oily substance, the resin comprising a cellulose acetate butyrate resin having a number average molecular weight of $2.0\times10^4$ to $5.0\times10^4$ and a glass transition point of 100° to 140° C., the oily substance being compatible with the cellulose acetate butyrate, and the mixing ratio of the cellulose acetate butyrate to the oily substance being from 3:10 to 7:5 by weight, wherein the oily substance is at least one member selected from the group consisting of an adipic acid ester, a sebacic acid ester, an azelaic acid ester and a trimethylolpropane fatty acid triester.

DETAILED DESCRIPTION

The fundamental structure of the pressure-sensitive magnetic transfer recording medium of the present invention is one wherein a pressure-sensitive transferable magnetic ink layer is provided on a support, and the pressure-sensitive transferable magnetic ink layer is a selectively transferable pressure-sensitive ink layer in a solid or semisolid state which means that, when the recording medium is superimposed on a receptor and pressure is applied to the ink layer from the rear side of the support or the rear side of the receptor by means of an impact member such as wire dot pin or type, only the portion of the ink layer onto which pressure is applied is separated from those onto which pressure is not applied and transferred to the receptor to give a printed image. The pressure-sensitive transferable magnetic ink layer is formed by applying a magnetic ink composition onto a support, followed by drying. The magnetic ink composition is prepared by adding into an organic solvent a vehicle composed of a resin as a main component and an oily substance as a plasticizer, and a ferromagnetic substance powder, and optionally an appropriate coloring agent, body pigment, dispersing agent or the like, followed by uniform mixing.

The present invention is characterized in that in the pressure-sensitive transferable magnetic ink layer composed of a magnetic substance powder, a resin and an oily substance, the resin comprises a cellulose acetate butyrate resin (hereinafter referred to as "CAB resin") having a number average molecular weight of $2.0\times10^4$ to $5.0\times10^4$ and a glass transition point (hereinafter referred to as "Tg") of 100° to 140° C., the oily substance is compatible with the CAB resin, and the mixing ratio of the CAB resin to the oily substance is from 3:10 to 7:5 by wherein the oily substance is at least one member selected from the group consisting of an adipic acid ester, a sebacic acid ester, an azelaic acid ester and a trimethylolpropane fatty acid triester.

In accordance with the present invention, in order to achieve the compatibility of the transfer sensitivity and the preservability (particularly antiblocking property), a CAB resin having specific molecular weight and Tg is used as the resin component of the vehicle and an oily substance with compatible with the CAB resin is used in a specific mixing ratio with the CAB resin. Thus, the CAB resin and the oily substance are mixed homogeneously with each other to form a homogenous phase which is soft but not excessively soft and the oily substance hardly bleeds out from the resulting pressure-sensitive transferable magnetic ink layer. As a result, good transfer sensitivity is achieved and even when the recording medium wound in the form of a roll is exposed to a high temperature environment, blocking does not occur. Further, since the CAB resin and the oil substance form a homogenous phase as described above, there is no chnage in performance between the recording medium immediately after the production and that after an passage of time. Futhermore, since the CAB resin and the oil substance form a homogenous phase, the resulting magnetic ink layer involves no parts which are rich or poor with a component and no parts which are partially soft or hard. Thus, stable transfer performance is ensured and the scratch resistance is improved.

The CAB resin used in the present invention has a number average molecular weight of $2.0\times10^4$ to $5.0\times10^4$ and Tg of 100° to 140° C.

The use of a CAB resin having a number average molecular weight of less than the above range provides an ink layer having an excessively small cohesive force, resulting in printed images involving voids and having a poor scratch resistance due to its softness. The use of a CAB resin having a number average molecular weight of more than the above range provides an ink layer having an excessively large cohesive force, resulting in unclear printed images due to large force required to separate the portion of the ink layer to be transferred from the remaining portion.

Further, when a CAB resin having Tg of lower than the above range is used, the resulting recording medium is good in transfer sensitivity, but when the recording medium wound in the form of a roll is exposed to a high temperature environment, the recording medium is prone to cause blocking and, hence, is less practicable. When a CAB resin having Tg of higher than the above range is used, the resulting recording medium shows poor transfer sensitivity at a low temperature enviroment, which makes it difficult to use the recording medium in cold places.

Any conventional CAB resins can be used so long as they meet the above-mentioned requirements. These CAB resins can be used alone or in combination of two or more species thereof.

The oily substance used in the present invention is one compatible or miscible with the CAB resin. When an oily substance incompatible with the CAB resin is used, the oily substance and the CAB resin cause phase separation in the resulting pressure-sensitive transferable magnetic ink layer. In that case, even though there is no problem in the performance of the recording medium immediately after the production, the plasticization of the ink layer with the oil substance gradually proceeds with time, thereby causing a change in the transfer performance. As a result, it is difficult to provide products with stable quality.

In the present invention, the mixing ratio of the CAB resin to the oily substance ranges from 3:10 to 7:5 (by weight, hereinafter the same). When the proportion of the oily substance is more than the above range, the plasticization of the CAB resin proceeds excessively. As a result, the resulting recording medium is good in transfer sensitivity, but when the recording medium wound in the form of a roll is exposed to a high temperature environment, the recording medium is prone to cause blocking and, hence, less practicable, as in the case of using a CAB resin having too low of a Tg. When the proportion of the CAB resin is more than the above range, the cohesive force of the ink layer per se becomes excessively strong, resulting in unclear printed images due to the large force required to separate the portion of the ink layer to be transferred from the remaining portion.

The oily substance compatible with the CAB resin are one or more members selected from the group consisting of an adipic acid ester, a sebacic acid ester, an azelaic acid ester and a trimethylolpropane fatty acid ester. These oily substances are plasticizers, each of which has good compatibility with the CAB resin and imparts excellent softness at low temperatures to the CAB resin. Thus, the use of these oily substances exerts more favorably the desired effects of the present invention such as high transfer sensitivity, good stability in transfer performance, good preservability and good scratch resistance of the resulting printed images, and further exerts good low-temperature transferability.

Preferable as the adipic acid ester, sebacic acid ester or azelaic acid ester are dialkyl esters wherein the alkyl group has 4 to 10 carbon atoms. Typical examples of these esters are dioctyl adipate, diisobutyl adipate, dibutyl adipate, diisodecyl adipate, dioctyl azelate, dibutyl sebacate and dioctyl sebacate. Preferable as the trimethylolpropane fatty acid triester is triester of trimethylolpropane with an aliphatic monocarboxylic acid having 8 to 12 carbon atoms. Examples of the aliphatic monocarboxylic acid are octanoic acid, nonanoic acid, decanoic acid, undecanoic acid and dodecanoic acid.

The pressure-sensitive transferable magnetic ink layer in accordance with the present invention preferably comprises 20 to 70% (% by weight, hereinafter the same) of a particulate magnetic substance, 10 to 50% of a CAB resin, 7.5 to 60% of an oily substance, and optionally 0 to 30% of a coloring agent and 0 to 30% of a wax, on the basis of the dry weight of the magnetic ink layer. The magnetic ink layer can be formed by applying a coating liquid for the magnetic ink layer onto a support, followed by drying. The coating liquid is prepared by dissolving or dispersing the above-mentioned components into an organic solvent. Examples of the organic solvent are methyl ethyl ketone, methyl isobutyl ketone, cyclohexane, ethyl acetate, butyl acetate, isopropyl acetate, dioxane and ethylbenzene. These organic solvents may be used alone or as a mixture of one or more species.

As described above, the content of the particulate magnetic substance is preferably from 20 to 70% on the basis of the dry weight of the magnetic ink layer. When the content of the magnetic substance is lower than the above range, the resulting printed image has poor magnetic characteristics, causing a hindrance in reading the image by means of MICR. When the content of the magnetic substance is higher than the above range, the content of the vehicle is relatively decreased, resulting in poor pressure-sensitive transferability and decreased bonding strength of the printed image to a receiving paper.

Useful as the particulate magnetic substance in the present invention are magnetic iron oxides used in various types of conventional magnetic recording media. A preferred magnetic iron oxide is needle-like λ-type iron oxide (λ $Fe_2O_3$) prepared by using α $Fe_2O_3.H_2O$ as a starting material. The iron oxide is used in the form of a fine powder to obtain a magnetic recording medium having stable coercive force, magnetic orientation, magnetic erasing effect and thermal stability.

In the present invention, there are also favorably used other magnetic iron oxides containing no bond water or combined water and no physically adsorbed water, such as λ-type, spinel-type, magnetoplumbite-type, garnet-type and orthoferrite-type iron oxides, oxides of metals other than iron, and eutectic mixtures of both metal oxides. Examples of the oxides of metals other than iron are chromium oxide $Cr_2O_3$, and the like. Examples of the eutectic mixtures are $CoO.Fe_2O_3$, $MnO.Fe_2O_3$, $NiO.Fe_2O_3$, $CuO.Fe_2O_3$, $MgO.Fe_2O_3$, $ZnO.Fe_2O_3$, and the like.

These particulate magnetic substances are preferably in a needle-like form and preferably have an aspect ratio (L/D) of 5:1 to 20:1, more preferably 5:1 to 10:1, a diameter of 0.01 to 1 μm, more preferably 0.02 to 0.5 μm, and a length of 0.05 to 20 μm, more preferably 0.1 to 5 μm.

Examples of the waxes optionally used are haze wax, ceresine wax, whale wax, carnauba wax, microcrystalline wax, and the like.

Usual dyes or pigments can be used as the coloring agent optionally used without any particular limitation The thickness of the pressure-sensitive transferable magnetic ink layer having such a constitution as described above is preferably from 3 to 15 μm.

Various conventional materials can be used as the support in the present invention. Examples of the support include plastic films such as polyolefin films, polyethylene terephthalate film, polycarbonate film, polyimide film and cellulose resin film; paper sheets such as condenser paper, laminate paper and glassine paper; laminate films such as laminate of paper sheet/plastic film; and metal foils such as aluminum foil. The thickness of the support is preferably from 2 to 100 μm, and more preferably from 10 to 20 μm for application of a suitable pressure to the magnetic ink layer of the recording medium.

When being used, the pressure-sensitive magnetic transfer recording medium of the present invention wound in the form of a roll is loaded into an impact printer such as typewriter or wire dot printer and is unwound and superimposed onto a given receptor paper such as a check paper sheet and the magnetic ink layer of the recording medium is selectively transferred onto the receptor paper by application of pressure from the rear side of the support or the rear side of the receptor paper to form a magnetic image.

The pressure-sensitive magnetic transfer recording medium of the present invention is used not only for forming magnetic character images for the above-mentioned E13B and CMC-7 type faces but also for forming other magnetic character images by means of an impact printer.

PREFERRED EMBODIMENTS

The present invention will be more fully described by way of Examples and Comparative Examples. It is to be understood that the present invention is not limited to these Examples, and various changes and modifications may be made in the invention without departing from the spirit and scope thereof.

Examples 1 to 6 and Comparative Examples 1 to 5

Each coating liquid of the formula shown in Table 1 for the pressure-sensitive transferable magnetic ink layer was uniformly applied onto a 16 μm-thick polyethylene film and dried to form a pressure-sensitive transferable magnetic ink layer having a thickness of 6 μm, yielding a pressure-sensitive magnetic transfer recording medium.

The particulars of the CAB resins and oily substances shown in Table 1 are as follows:

CAB resin A: available under the commercial name "CAB-551-0.2" from EASTMAN CHEMICAL PRODUCTS, INC.

CAB resin B: available under the commercial name "CAB-381-2" from EASTMAN CHEMICAL PRODUCTS, INC.

CAB resin C: available under the commercial name "CAB-531-1" from EASTMAN CHEMICAL PRODUCTS, INC.

CAB resin D: available under the commercial name "CAB-551-0.01" from EASTMAN CHEMICAL PRODUCTS, INC.

CAB resin E: available under the commercial name "CAB-171-15S" from EASTMAN CHEMICAL PRODUCTS, INC.

DOZ: dioctyl azelate

DIDA: diisodecyl adipate

DOS: dioctyl sebacate

H-334R: commercial name of trimethylolpropane octanoic acid triester available from NOF Corporation RRO: commercial name of a refined rapeseed oil (Sirashimeyu) available from Nikka Yushi Kabushiki Kaisha The compatibility of the oil with the CAB resin was determined as follows: A solution containing 15% of a CAB resin, 15% of an oily substance and 70% of ethyl acetate was prepared. The solution was uniformly applied onto a 16 μm-thick polyethylene film. The compatibility was determined by evaluating the state of the resulting coating film according to the following criterion:

○. . . transparent, even surface (compatible)

X . . . cloudy, uneven surface (incompatible)

TABLE 1

| | Example | | | | | | Comparative Example | | | | |
|---|---|---|---|---|---|---|---|---|---|---|---|
| | 1 | 2 | 3 | 4 | 5 | 6 | 1 | 2 | 3 | 4 | 5 |
| Coating liquid (%) | | | | | | | | | | | |
| CAB resin | 5.0 | 4.0 | 5.0 | 3.6 | 8.0 | 8.0 | 5.0 | 4.0 | 4.0 | 2.0 | 10.0 |
| Oily substance | 7.0 | 8.0 | 7.0 | 10.4 | 6.0 | 6.0 | 7.0 | 8.0 | 8.0 | 12.0 | 4.0 |
| $Fe_3O_4$ | 8.0 | 8.0 | 8.0 | 8.0 | 8.0 | 8.0 | 8.0 | 8.0 | 8.0 | 8.0 | 8.0 |
| Ethyl acetate | 80.0 | 80.0 | 80.0 | 78.0 | 78.0 | 78.0 | 80.0 | 80.0 | 80.0 | 78.0 | 78.0 |

TABLE 1-continued

| | Example | | | | | | Comparative Example | | | | |
|---|---|---|---|---|---|---|---|---|---|---|---|
| | 1 | 2 | 3 | 4 | 5 | 6 | 1 | 2 | 3 | 4 | 5 |
| CAB resin | | | | | | | | | | | |
| Kind | A | B | C | B | A | A | D | E | B | B | A |
| Tg (° C.) | 101 | 133 | 115 | 133 | 101 | 101 | 85 | 161 | 133 | 133 | 101 |
| Mn*1 | $3 \times 10^4$ | $4 \times 10^4$ | $4 \times 10^4$ | $4 \times 10^4$ | $3 \times 10^4$ | $3 \times 10^4$ | $1.6 \times 10^4$ | $6.5 \times 10^4$ | $4 \times 10^4$ | $4 \times 10^4$ | $3 \times 10^4$ |
| Oily substance | DIDA | DIDA | DOZ | DOZ | DOS | H-334R | DIDA | DIDA | RRO | DOZ | DOS |
| Compatibility | ○ | ○ | ○ | ○ | ○ | ○ | ○ | ○ | X | ○ | ○ |
| Ratio of CAB/oil*2 | 5/7 | 1/2 | 5/7 | 9/26 | 4/3 | 4/3 | 5/7 | 1/2 | 1/2 | 1/6 | 5/2 |

*1Number average molecular weight
*2Ratio of CAB resin/oily substance by weight

Each of the above-mentioned coating liquids for the magnetic ink layer was prepared by the following two-step method:

Step 1: A CAB resin was dissolved by means of a homogenizer.

Step 2: A magnetic substance powder, the CAB resin solution obtained in Step 1 and an oily substance were mixed and the resulting mixture was milled in a ball mill for 180 minutes.

Each of the thus-obtained pressure-sensitive magnetic transfer recording media was evaluated for the following properties. The results thereof are shown in Table 2.

Evaluation of transfer sensitivity and occurrence of bridging portions in printed image With respect to the pressure-sensitive magnetic transfer recording media obtained in Examples and Comparative Examples, the transfer characteristics were evaluated. Using a Bond paper sheet (Strathmore Bond, cotton fiber 25%) as a receptor paper, printing was performed by means of a typewriter (AP 110II made by CANON BUSINESS MACHINES, INC.) to print a character "M" and a character "¶" of modern font. 25 characters for each of M and ¶ were printed for every change of 0.1 within the printing pressure range from 2.8 to 4.0. The printing pressure value ranging from 2.8 to 4.0 was that prescribed in the typewriter used (hereinafter the same).

Evaluation of Transfer Sensitivity

With respect to 25 characters of M obtained for each printing pressure, characters involving voids were counted. The lowest printing pressure value for which the number of characters involving voids among 25 characters is zero is taken as "transfer sensitivity". It is judged that as the printing pressure value for which the number of characters involving voids is zero is smaller, the transfer sensitivity is higher.

Evaluation of Occurrence of Bridging Portions in Printed Image

With respect to all characters of ¶ obtained for all printing pressures, characters involving bridging portions were counted. It is judged that as the number of characters ¶ involving bridging portions is smaller, the separability of the magnetic ink layer is better, resulting in a clear MICR character, and that as the number of characters ¶ involving bridging portions is larger, the separability of the magnetic ink layer is poorer, resulting an unclear MICR character.

Evaluation of Scratch Resistance

Each of the pressure-sensitive magnetic transfer recording media obtained in Examples and Comparative Examples was slit into ribbons each having a width of 8 mm. The ribbon was loaded in a cassette for a MICR encoder (FZ-1144 made by Fuji System Kabushiki Kaisha). Printing was performed by means of the MICR encoder to print on a specified paper sheet magnetic images (61 characters) of E13B type face prescribed in JIS X 9002 using the self printing pattern of the encoder.

A specified paper sheet having no magnetic images was placed on the magnetic images and reciprocated 5 times under a load of 500 g/cm$^2$. The scratch resistance was determined by evaluating the state of the magnetic images after rubbing according to the following criterion:

⊙. . . No changes in the magnetic images occur.

○. . . Changes in profile of the magnetic images occur but the changes are within the standard.

Δ. . . Changes in profile of the magnetic images and smudge of the paper sheet occur.

X . . . The magnetic images are deformed and damaged outside the standard.

Evaluation of Low-Temperature Transferability

Each of the pressure-sensitive magnetic transfer recording media obtained in Examples and Comparative Examples was slit into ribbons each having a width of 8 mm. The ribbon was loaded in a cassette for a MICR encoder (FZ-1144 made by Fuji System Kabushiki Kaisha). Printing was performed by means of the MICR encoder with keeping the printing environment temperature to 10° C. to print on a specified paper sheet magnetic images (61 characters) of E13B type face prescribed in JIS X 9002 using the self printing pattern of the encoder.

Characters involving voids were counted according to JIS X 9002. It is judged that as the number of characters involving voids is smaller, the low-temperature transferability is better.

Evaluation of Stability with Time

The above-mentioned evaluation tests for the transfer sensitivity, occurrence of characters involving bridging portions, scratch resistance and low-temperature transferability were again conducted using the recording media after 30 days from the production thereof. It was confirmed whether there is a change between the performance of the recording media after 30 days from the production and that immediately after the production. In the case that a change was observed, the stability with time was judged as "poor". In the case that no change was observed, the stability with time was judged as "good".

○. . . Good stability with time

X . . . Poor stability with time

Evaluation of Preservability

Each of the pressure-sensitive magnetic transfer recording media obtained in Examples and Comparative Examples was slit and cut into ribbons each having a length of 1 m and a width of 8 mm. The ribbon was wound up on a core made of ABS resin having an outer diameter of 15 mm at a constant speed while a load of 150 gf was applied to the free end of the ribbon and the end of the ribbon was secured by means of an adhesive tape, yielding a ribbon sample. The ribbon sample was allowed to stand for 48 hours in an environment where the temperature was 50° C. and the humidity was 85% RH. After the ribbon sample was taken out from the environment, it was confirmed whether the blocking occurred.

○. . . No blocking occurs.

X . . . Blocking occurs.

not deteriorated at a low-temperature environment. The stability of the transfer performance with time was good. No blocking occurred after storage.

The pressure-sensitive magnetic transfer recording medium of the present invention wherein a specific CAB resin and an oily substance compatible with the CAB resin are used in combination as the vehicle of its magnetic ink layer has excellent transfer sensitivity and provides magnetic images having excellent scratch resistance and does not cause blocking due to the migration of the magnetic ink during storage at a high temperature environment. Further, the recording medium causes no deterioration of transfer performance at a low temperature environment and has excellent stability of transfer performance with time.

In addition to the materials and ingredients used in the Examples, other materials and ingredients can be used in the present invention as set forth in the specification to obtain substantially the same results.

TABLE 2

| | Example | | | | | | Comparative Example | | | | |
|---|---|---|---|---|---|---|---|---|---|---|---|
| | 1 | 2 | 3 | 4 | 5 | 6 | 1 | 2 | 3 | 4 | 5 |
| Transfer sensitivity (Void in character M) | 3.2 | 3.3 | 3.2 | 3.3 | 3.2 | 3.2 | 3.2 | 3.4 | 3.2 | 3.1 | 3.2 |
| Number of characters ¶ involving bridging portions | 0 | 5 | 3 | 5 | 0 | 0 | 0 | 25 | 5 | 0 | 10 |
| Scratch resistance | ○ | ◎ | ○ | ◎ | ○ | ◎ | X | ◎ | ○ | X | ○ |
| Low-temperature transferability | 0 | 1 | 0 | 1 | 0 | 0 | 0 | 30 | 5 | 0 | 5 |
| Stability with time | ○ | ○ | ○ | ○ | ○ | ○ | ○ | ○ | X | ○ | ○ |
| Preservability (blocking) | ○ | ○ | ○ | ○ | ○ | ○ | X | ○ | ○ | X | ○ |

The allowed values for the evaluation items are as follows:

Transfer sensitivity (voids in character M): not more than 3.3

Number of characters 1 involving bridging portions: not more than 20

Scratch resistance: ○ or ◎

Low-temperature tranferability (number of characters involving voids when transferring at 10° C.): not more than 2

Stability with time: ○

Preservability (blocking after storage): ○

As is apparent from Table 2, the pressure-sensitive magnetic transfer recording media of all Examples had good transfer sensitivity, thereby providing clear magnetic images involving fewer voids and the obtained images had good scratch resistance. These recording media had further excellent characteristics as follows: The transfer performance was

What is claimed is:

1. A pressure-sensitive magnetic transfer recording medium comprising a support and a pressure-sensitive transferable magnetic ink layer provided on the support, the pressure-sensitive transferable magnetic ink layer comprising a particulate magnetic substance, a resin and an oily substance, the resin comprising a cellulose acetate butyrate resin having a number average molecular weight of $2.0\times10^4$ to 5.0×104 and a glass transition point of 100° to 140° C., the oily substance being compatible with the cellulose acetate butyrate resin, and the mixing ratio of the cellulose acetate butyrate to the oily substance being from 3:10 to 7:5 by weight, wherein the oily substance is at least one member selected from the group consisting of an adipic acid ester, a sebacic acid ester, an azelaic acid ester and a trimethylolpropane fatty acid triester.

* * * * *